US006382420B1

(12) United States Patent
Bouthiette

(10) Patent No.: US 6,382,420 B1
(45) Date of Patent: May 7, 2002

(54) PEELABLE SEALING SHEET FOR INDIVIDUAL PILL CONTAINERS AND METHOD FOR MANUFACTURING THE SAME

(75) Inventor: Michel Bouthiette, Granby (CA)

(73) Assignee: Dispill Inc., Granby (CA)

( * ) Notice: Subject to any disclaimer, the term of this patent is extended or adjusted under 35 U.S.C. 154(b) by 0 days.

(21) Appl. No.: 09/718,502

(22) Filed: Nov. 24, 2000

(51) Int. Cl.[7] ..... B65D 83/04

(52) U.S. Cl. ..... 206/534; 206/538; 53/471

(58) Field of Search ..... 206/528, 530, 206/534, 534.1, 538, 539, 484, 484.2; 53/467, 471, 485, 487, 488

(56) References Cited

U.S. PATENT DOCUMENTS

| | | | | |
|---|---|---|---|---|
| 3,630,346 A | * | 12/1971 | Burnside | 206/484 |
| 3,715,856 A | * | 2/1973 | Borel | 53/487 |
| 3,780,856 A | | 12/1973 | Braverman | |
| 3,924,748 A | * | 12/1975 | Braverman | 206/538 |
| 3,933,245 A | | 1/1976 | Mullen | |
| 4,416,375 A | * | 11/1983 | Braverman et al. | 206/538 |
| 4,553,670 A | | 11/1985 | Collens | |
| 4,673,086 A | * | 6/1987 | Braverman et al. | 206/538 |
| 4,860,899 A | | 8/1989 | McKee | |
| 5,014,851 A | * | 5/1991 | Wick | 206/539 |
| 5,046,618 A | | 9/1991 | Wood | |
| 5,788,079 A | | 8/1998 | Bouthiette | |

FOREIGN PATENT DOCUMENTS

| | | |
|---|---|---|
| CA | 2264339 | 5/1999 |

* cited by examiner

*Primary Examiner*—Luan K. Bui
(74) *Attorney, Agent, or Firm*—Robic

(57) ABSTRACT

A sealing sheet for use to close in a reversible manner a plurality of individual pill containers formed in a plastic sheet. The sealing sheet has a top layer, an adhesive layer and a peelable backing. The top layer and the adhesive layer are made of paper. The adhesive layer has a plurality of spaced apart holes punched therein, which are surrounded by adhesive layer bands having an upper surface that is covered with an upper layer of pressure sensitive adhesive glue and is attached by this glue to the top layer, and a lower surface covered with a lower layer of removable re-positionable pressure sensitive adhesive glue. The peelable backing also has a plurality of spaced apart holes that are positioned, shaped and sized to be in exact superimposition below the holes of the pressure sensitive adhesive glue layer. The holes of the backing are surrounded by backing bands having an upper surface detachably fixed to the lower surface of the adhesive layer bands by means of the lower layer of removable re-positionable pressure sensitive adhesive glue. In use, the backing bands can be peeled off from the pressure sensitive adhesive glue layer bands to allow fixation of the sealing sheet onto the container-defining sheet. Tearing lines are punched into both the top layer and the pressure sensitive adhesive glue layer bands in such a manner and position as to allow the top layer and pressure sensitive adhesive glue layer to be split into a number of cover pieces equal to the number of holes made in the pressure sensitive adhesive glue layer.

19 Claims, 12 Drawing Sheets

PEELABLE SEALING SHEET FOR INDIVIDUAL PILL CONTAINERS AND METHOD FOR MANUFACTURING THE SAME

BACKGROUND OF THE INVENTION a) Field of the Invention

The present invention relates to a peelable sealing sheet for use to close in a reversible manner a plurality of individual pill containers.

The invention also relates to a method for manufacturing this peelable sealing sheet.

The invention further relates to a set of individual pill containers comprising a sheet of plastic material defining a plurality of individual containers closed in a reversible manner by the so-manufactured peelable sealing sheet.

b) Brief Description of the Prior Art

It is of common practice in the pharmaceutical field to prepare sets of individual containers containing pills and/or tablets to be administered to a patient. Each of these containers contains pills and/or tablets that the patient has to take together at the same time during the day over a given period of time (preferably one week).

To prepare such sets of individual pill containers for use by a patient, it is also of common practice to use a sheet of plastic material in which a plurality of recesses are molded. Each of these recesses defines a small upwardly opened container that can be filled with pills. After filling, all the containers are closed by means of a sealing sheet on which all desirable indications can be printed, like the patient's name, the date and hour of administration, etc. As it can be understood, the indications are printed and formatted onto the sealing sheet so that each group of information referring to a given container is positioned in regard to said container. Tearing lines are provided on both the container-defining sheet and the sealing sheet to permit easy separation of the individual pill containers.

In practice, the sealing sheet can be made of plastic material and be thermosealed onto the container-defining sheet. Alternatively, the sealing sheet can be made of paper and be glued onto the container-defining sheet.

For further information as to the structure, manufacture and use of such sets of individual pill containers, reference can be made to U.S. Pat. No. 5,788,079 and its Canadian counterpart No. 2,207,045 both in the name of the present inventor, and to all the prior art that was cited during their prosecution.

If, so far, the existing sets of individual pill containers have proved to be particularly useful and efficient, they still suffer from a major deficiency, viz. the fact that once a given container of the set is opened by tearing or peeling off the corresponding portion of the sealing sheet, it cannot be closed again. Thus, if there has been any mistake in the way one or more of the containers were originally filled with pills, there is no way of repairing this error and one must get rid of the whole set. Similarly, if the patient or his/her nurse has not opened the right container by inadvertence, there is no way of repairing this error since the inadvertently opened container cannot be closed back.

In Canadian laid-open patent application No. 2,264,339 also in the name of the present inventor, there is disclosed a reversible peelable sealing sheet made of paper, which, thanks to its structure, solves all the problems related to the above mentioned deficiency inasmuch as it allows each of the containers of the set to be opened and closed back whenever desired, even when the container is still part of the set. This sealing sheet comprises three layers, namely:

a top layer made of paper;

an adhesive layer made of a sheet of paper whose upper and lower surfaces are covered with a layer of pressure sensitive adhesive glue; and a peelable backing.

The adhesive layer has precut central pieces surrounded by bands. Similarly, the backing has precut central pieces surrounded bands that are positioned shaped and sized to be in exact superposition below the central pieces and surrounding bands of the adhesive layer.

The precut bands of the backing define a protective peelable covering that is peeled off before installation of the sealing sheet on top of the container-defining sheet. The central pieces of the adhesive layer and of the backing remain sticked to each other and to the lower surface of the top layer and altogether form a plurality of non-sticking protective pads fitting on top of the cavities made in the container-defining sheet.

This sealing sheet is quite efficient. However, it has been found that, in use, some of the central pieces unstick from the top layer and fall down when the sealing sheet is installed or when, after installation, one tries to open some containers. Then, when the containers are closed back, the pills stored therein may stick to the bottom surface of the top layer on which some adhesive always remains.

SUMMARY OF THE INVENTION

A first object of the present invention is to provide a reversibly peelable sealing sheet for use to close a container-defining sheet, which is as efficient as the one disclosed in Canadian laid-open application No. 2,264,339 but does not have the same drawback in use.

The sealing sheet according to the invention basically comprises:

a top layer made of paper and having an upper surface defining the top surface of the sealing sheet, and a lower surface; and an adhesive layer made of paper and having a plurality of spaced apart holes punched therein, the holes being surrounded by adhesive layer bands that form said adhesive layer, the adhesive layer bands having an upper surface covered with an upper layer of pressure sensitive adhesive glue and a lower surface covered with a lower layer of removable re-positionable pressure sensitive adhesive glue, said adhesive layer bands being fixed to the lower surface of the top layer by the upper layer of pressure sensitive adhesive glue;

a peelable backing having a plurality of spaced apart holes that are positioned, shaped and sized to be in exact superimposition below the holes of the adhesive layer, the holes of the backing being surrounded by backing bands that forms said backing, the backing bands having an upper surface detachably fixed to the lower surface of the adhesive layer bands by means of the lower layer of removable re-positionable pressure sensitive adhesive glue, whereby the backing bands can be peeled off from the adhesive layer bands to allow fixation of the sealing sheet onto the container-defining sheet; and tearing lines punched into the top layer and the adhesive layer bands in such a manner and position as to allow the top layer and adhesive layer to be split into a number of cover pieces equal to the number of holes made in the adhesive layer, each of the cover pieces having one of the holes of the adhesive layer that is centrally positioned therein and fully surrounded by a flange made of parts of the adhesive layer bands.

As can be appreciated, there are no more central pieces left onto the adhesive layer and the peelable backing. Rather, these pieces are removed thereby leaving holes below the top layer, which are sized, shaped and positioned to extend over the containers of the container-defining sheet.

A second object of the invention is to provide a method for manufacturing peelable sealing sheets according to the invention as defined hereinabove. This method comprises the steps of:

a) providing a three-layered sheet comprising:
   - a central sheet made of paper and having an upper surface covered with an upper layer of pressure sensitive adhesive glue and a lower surface covered with a lower layer of removable re-positionable pressure sensitive adhesive glue;
   - an upper backing sheet fixed to the upper surface of the central sheet; and
   - a lower backing sheet detachably fixed to the bottom surface of the central sheet;

b) punching the three-layered sheet in order to cut spaced apart sets of superimposed pieces into both of the central sheet and the lower backing sheet;

c) peeling off the upper backing sheet together with the sets of pieces cut into the central sheet and lower backing sheet of the three-layered sheet, whereby a two layered sheet made of the central sheet and lower backing sheet with holes therein corresponding to the peeled off pieces is obtained, the holes being surrounded by bands left into the central sheet and the lower backing sheet, d) providing a single sheet of paper;

e) applying the single sheet of paper onto the upper surface of the central sheet of the two-layered sheet obtained in step c) so to form another three-layered sheet;

f) punching tearing lines into the single sheet of paper and the bands of the central sheet of the three-layered sheet obtained in step e) in such a manner as to allow the single sheet of paper and the bands of the central sheet to be slit whenever desired into a number of cover pieces equal to the number of holes made in said central sheet; and g) punching cutting lines in the punched, three-layered sheet obtained in step f) to facilitate splitting of this three-layered sheet into the requested sealing sheets, the so cut-single sheet, central sheet and lower back sheet respectively acting as top layer, adhesive layer and backing of each of the so obtained sealing sheets.

A third object of the invention is to provide a set of individual pill containers comprising a sheet of plastic material defining a plurality of individual containers closed in a reversible manner by the so-manufactured peelable sealing sheet.

The invention and its advantages will be better understood upon reading the following non-restrict description of a preferred embodiment of the invention, made with reference to the accompanying drawings.

DESCRIPTION OF A PREFERRED EMBODIMENT OF THE INVENTION

Figure 1:
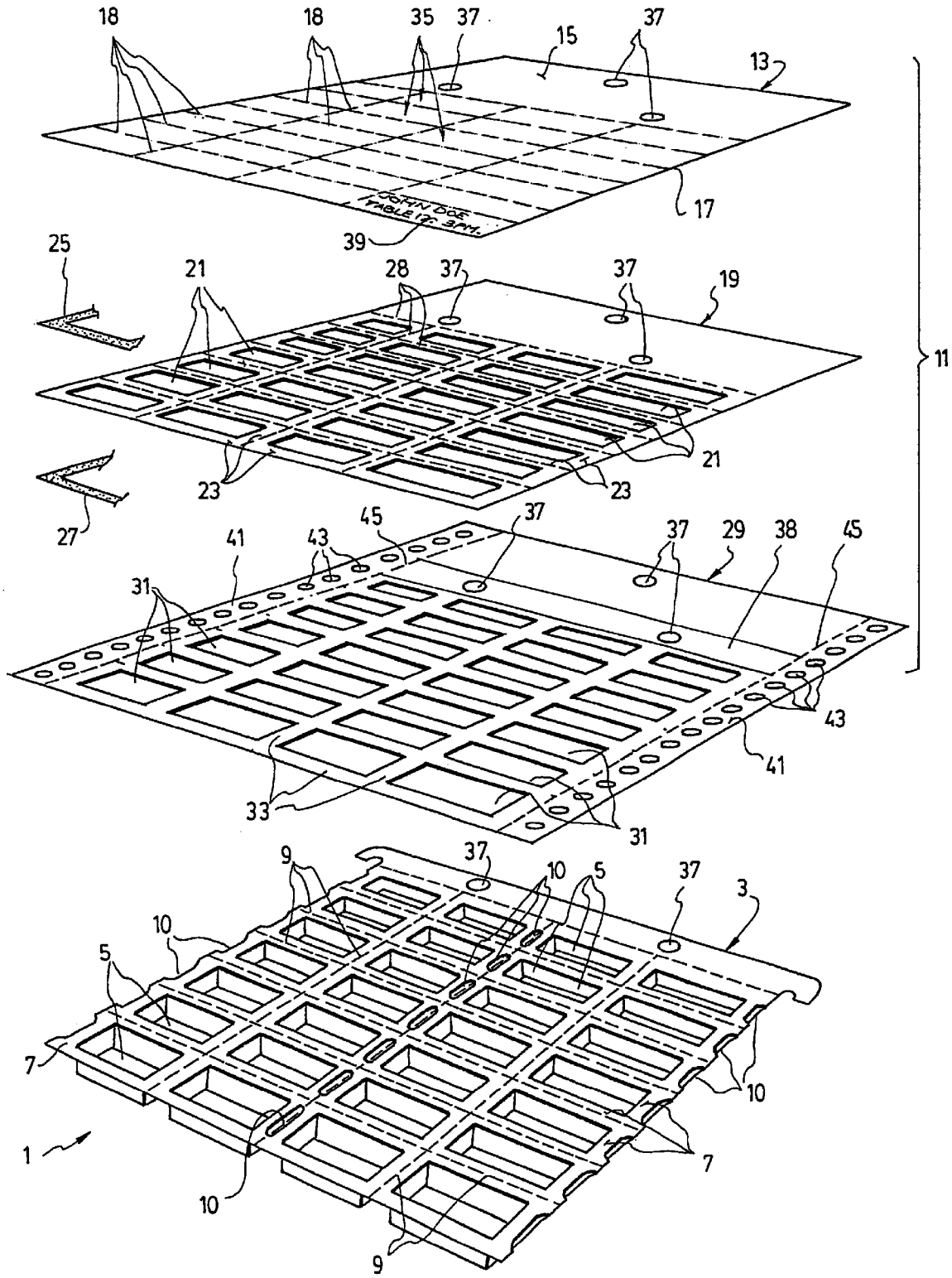
FIG. 1 is an exploded perspective view of a set of individual pill containers incorporating a reversibly peelable sealing sheet according to a preferred embodiment of the invention.

FIG. 1 illustrates a set 1 of individual pill containers incorporating a reversibly peelable sealing sheet 11 according to a preferred embodiment of the invention.

As is shown, the set 1 comprises a container-defining sheet 3 made of plastic material, which has a top surface with a given number of spaced apart cavities 5 embossed therein. Each of the cavities 5 is upwardly opened and defines a container that is surrounded by a flange 7.

As is shown, each of the flanges 7 that are not directly adjacent to one side of the container-defining sheet are provided with a central dotted line 9 punched therein to make it possible to detach each of the containers 5 from the adjacent containers, and thus from the remaining of the container-defining sheet 3 whenever desired.

Preferably, the containers defined by the cavities 5 of the container-defining sheet 3 are rectangular in shape and positioned to form rows and columns. In accordance with a particularly preferred embodiment of the invention, the container-defining sheet 3 is devised to define twenty-eight containers 5, which are positioned to define seven rows and four columns. The four columns correspond to the four periods of the day when pills are usually given (i.e. morning, noon, evening and night). The seven rows correspond to the days of one week. However, it can be appreciated that the numbers of containers 5 as well as the numbers of columns and/or rows could be changed as needs be.

In the case where, as is shown in FIG. 1, the containers 5 are positioned to define several rows and columns, recesses 10 are preferably provided into the flanges 7 in such a manner that at least one recess 10 extends adjacent to one side of each container 5. In the illustrated embodiment, said one side is one of the small sides of each container 5. Such a specific arrangement can be achieved by providing the recesses 10 along the side edges of the set 1 and along the dotted line 9 which extends in the middle of the set as is shown in FIG. 1. However, any other arrangement could be used provided that, as aforesaid, at least one depression 10 extends adjacent to one side of each container 5. The recesses 10 made in the container-defining sheet 3 give an easy finger access to each cover piece 35, once the corresponding container has been separated from the others. This feature and its advantages are already known and therefore need not be further desired (see, for example, U.S. Pat. No. 3,933,245 to MULLEN).

The set 1 also comprises a sealing sheet 11 positioned on top of the top surface of the container-defining sheet 3 in order to close each of the containers 5. More specifically, the sealing sheet 11 is shaped and sized to cover at least all the containers 5 and the surrounding flanges 7 of the container-defining sheet 3. The sealing sheet 11 is also provided with tearing lines 18,28 as will be explained hereinafter, which are positioned to be in superposition on top of the dotted lines 9 of the container-defining sheet 3 to make it possible to tear the sealing sheet 11 into the requested number of cover pieces 35 corresponding to the number of containers 5 and thus to detach each of the containers 5 without having to open the same.

In accordance with the invention, the sealing sheet 11 basically comprises:

- a top layer 13 made of paper and having an upper surface 15 and a lower surface 17;
- an adhesive layer 19 made of paper and having a plurality of spaced apart holes 21 that punched therein and are surrounded by adhesive layer bands 23 which actually form said adhesive layer 19; and
- a peelable backing 29 having a plurality of spaced apart holes 31 that are positioned, shaped and sized to be in exact superimposition below the holes 21 of the adhesive layer 19 and are surrounded by backing bands 33 which actually forms said backing 29.

As is shown, the adhesive layer bands 23 forming the adhesive layer 19 have an upper surface covered with an upper layer 25 of pressure sensitive adhesive glue and a lower surface covered with a lower layer 27 of removable re-positionable pressure sensitive adhesive glue. Thus, the adhesive layer 19 is fixed to the lower surface of the top layer by means of the upper layer 25 of pressure sensitive adhesive glue and to the upper surface of the backing bands 33 forming the backing 29 by means of the lower layer 27 of removable re-positionable pressure sensitive adhesive glue. The fact that the lower layer 27 of pressure sensitive adhesive glue must actually be made of a removable re-positionable pressure sensitive adhesive glue, viz. an adhesive that allow easy peeling off and "gluing back" of adjacent layers, is an essential feature of the invention since, in use, the backing bands 31 forming the backing 29 must be peeled off from the adhesive layer bands 23 forming the adhesive layer 19 to allow fixation of the sealing sheet 11 onto the container-defining sheet 3.

As is also shown, the holes 21 of the adhesive layer 19 are positioned, shaped and sized to be in exact superimposition on top the containers 5 of the container-defining sheet 3 when the sealing sheet 11 is installed onto the container-defining sheet 3. Of course, such an installation is achieved after the backing 29 has been peeled off from the adhesive layer 19.

As is further shown, tearing lines 18 and 28 are punched into the top layer 13 and the adhesive layer bands 23 in such a manner and position as to allow the top layer 13 and the adhesive layer 23 to be split into the requested number of cover pieces 35 equal to the number of holes 21 made in the adhesive layer 19, which is itself equal to the number of containers 5 made in the container-defining sheet 3. Of course, each of the cover pieces 35 has one of the holes 21 made in the adhesive layer 19, that is centrally positioned therein and fully surrounded by a flange made of parts of the adhesive layer bands 23.

As it can be understood, the upper surface 15 of the top layer 13 actually forms the top surface of the sealing sheet 11. Advantageously, this top surface may comprise information 39 printed on it in such a manner as to be positioned on top of each cavity 5 and thus to correspond to what is contained in the corresponding container. This information is of course related to the patient's prescription and may include the name of the patient, the day and time of administration, an identification of the room or table of the patient, etc.

In order to facilitate such a printing of information onto the upper surface 15 of the top layer 13, the peelable backing 29 is preferably larger in width than the top layer 13 and the adhesive layer 19, so as to define two bands 41 extending along the opposite sides of the sealing sheet. In the embodiment shown in FIGS. 1, 10 and 11, each band 41 is provided with a row of equally spaced apart holes 43 to facilitate guiding and driving of the sealing sheet through an automatic printing machine. In the embodiment shown in FIG. 12, the bands 41 have no holes. Such may be useful when the sealing sheets 11 are processed one by one in a laser or jet-ink machine. Such is very conventional in the field of prescriptions and needs not be further detailed. Of course, after the printing has been completed, the bands 39 may be torn off thanks to the presence of tearing lines 45 especially devised for this purpose. These lines are identified by reference numerals 127 in FIGS. 10 to 12.

As it can also be understood, each cover piece 35 defined by a corresponding portion of the top layer 13 and a corresponding portion of the adhesive layer bands 23 of the adhesive layer 19, is actually sticked onto the flanges 7 surrounding the cavity defining the corresponding container 5. In use, the cover piece 5 can be peeled off in a reversible manner from the flanges 7 of the corresponding container 5 to give access to the pill(s) contained therein. If a container 5 has been opened by inadvertence, it can be closed again by pressing the cover 35 back onto the flanges 7. This solves in a very simple yet efficient manner all the "access" problems mentioned hereinabove, which are presently encountered with the existing sets presently available in the market.

As it can further be understood, the lower surfaces 17 of the top layer that "face" the holes 21 of the adhesive layer 19 are left "free", with no adhesive and no central pieces glued to it. Thus, there is no risk that central pieces like those mentioned in Canadian laid-open application No. 2,264,339 fall down during or after installation, and therefore no risk of "interference" with the pill(s) stocked in the adjacent containers 5.

Preferably, positioning means can be provided on at least the top surface of the container-defining sheet 3 and on the sealing sheet 11 to ensure proper positioning of both of them with respect to each other during installation, and thus exact superimposition of the bands and tearing lines 18,28 of the sealing sheet over the corresponding flanges 7 and dotted lines 9 of the container-defining sheet 5. The positioning means may comprise holes 37 as shown in FIG. 1, which may cooperate with pegs provided onto a recessed support used for facilitating installation. Further detail regarding this feature and its advantages can be found in U.S. Pat. No. 5,788,079 and its corresponding Canadian counterpart No. 2,207,045 already cited to hereinabove. In positioning means may also comprise a peelable band 38 slit into the backing 29 so as to extend across the sealing sheet 11 at the level of the positioning holes 37. By peeling off the band 38 just before installing the sealing sheet 11 above the container defining sheet 3 inserted into the recessed support, one may ensure that both the sealing sheet 11 and the container-defining sheet 3 remain attached to each other even when the balance of the backing has not been removed yet and pressed onto the flanges of the container-defining sheet 3. Thus, one may check whenever all the containers 5 have been actually filled up and/or complete such a filling up in an easy manner.

The sheet 11 according to the preferred embodiment of the invention disclosed hereinabove can be manufactured in a continuous manner in a rolling press or in any similar machine.

Figure 2:
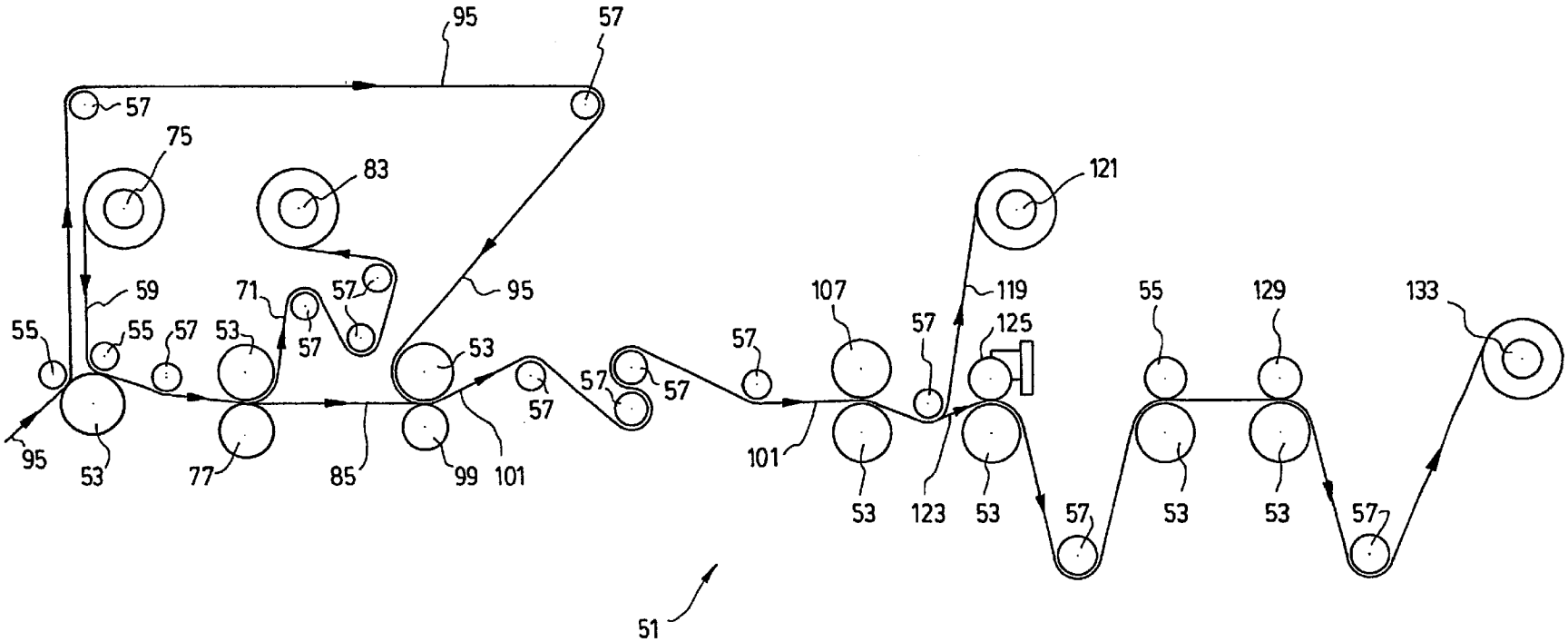
FIG. 2 is a schematic side-elevational view of a rolling press especially adapted for manufacturing the reversibility peelable sealing sheet shown in FIG. 1.

As shown in FIG. 2, the rolling press 51 used for this purpose is provided with a plurality of suitably positioned driving rolls 53, a plurality of suitably positioned nip rolls 55 and a plurality of guiding rolls 57.

Figure 4:
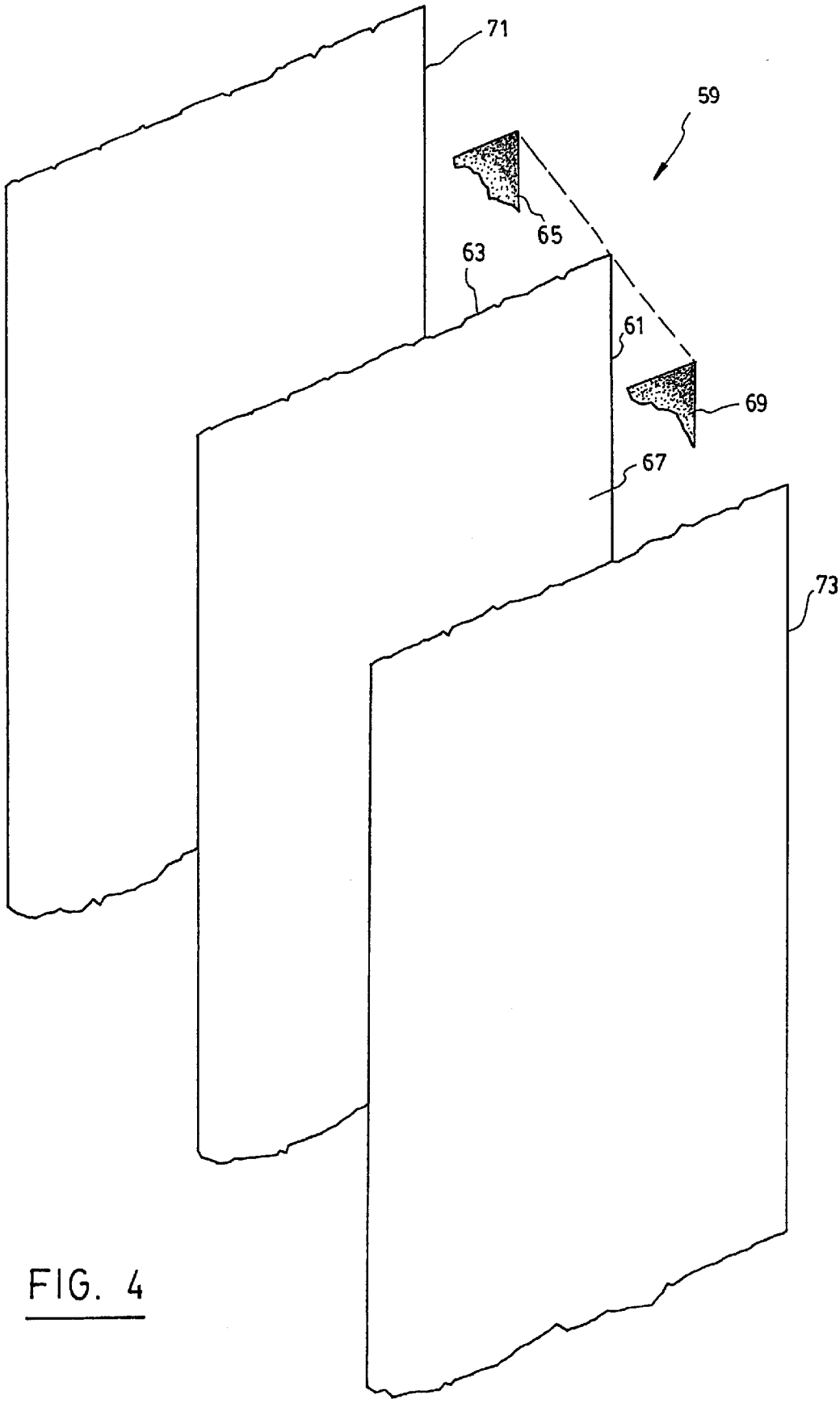
FIG. 4 is an exploded perspective view of part of the three-layered sheet used to form the adhesive layer and peelable backing of the sealing sheet, as it is fed to the rolling press.

The rolling press 51 is fed at one end with a three-layered sheet 59 mounted onto a supporting core 75. This three-layered sheet 59 is shown in exploded view in FIG. 4. It basically comprises a central sheet 61 made of paper and having an upper surface 63 covered with an upper layer 65 of pressure sensitive adhesive glue and a lower surface 67 covered with a lower layer of removable re-positionable pressure sensitive adhesive glue 69. This central sheet 61 and its upper and lower layers 65,69 of pressure sensitive adhesive glue actually corresponds to the adhesive layer 19 and to the upper and lower layers 25,27 of pressure sensitive adhesive glue once the sealing sheet 11 is obtained.

The three-layered sheet 59 also comprises a silicone-covered upper backing sheet 71 detachably fixed to the upper surface 63 of the central sheet 61 and a lower backing sheet 73 detachably fixed to the bottom surface 67 of the central sheet 61. This lower backing sheet 71 actually corresponds to the above mentioned backing 29 once the sealing sheet 11 is obtained.

Figure 5:
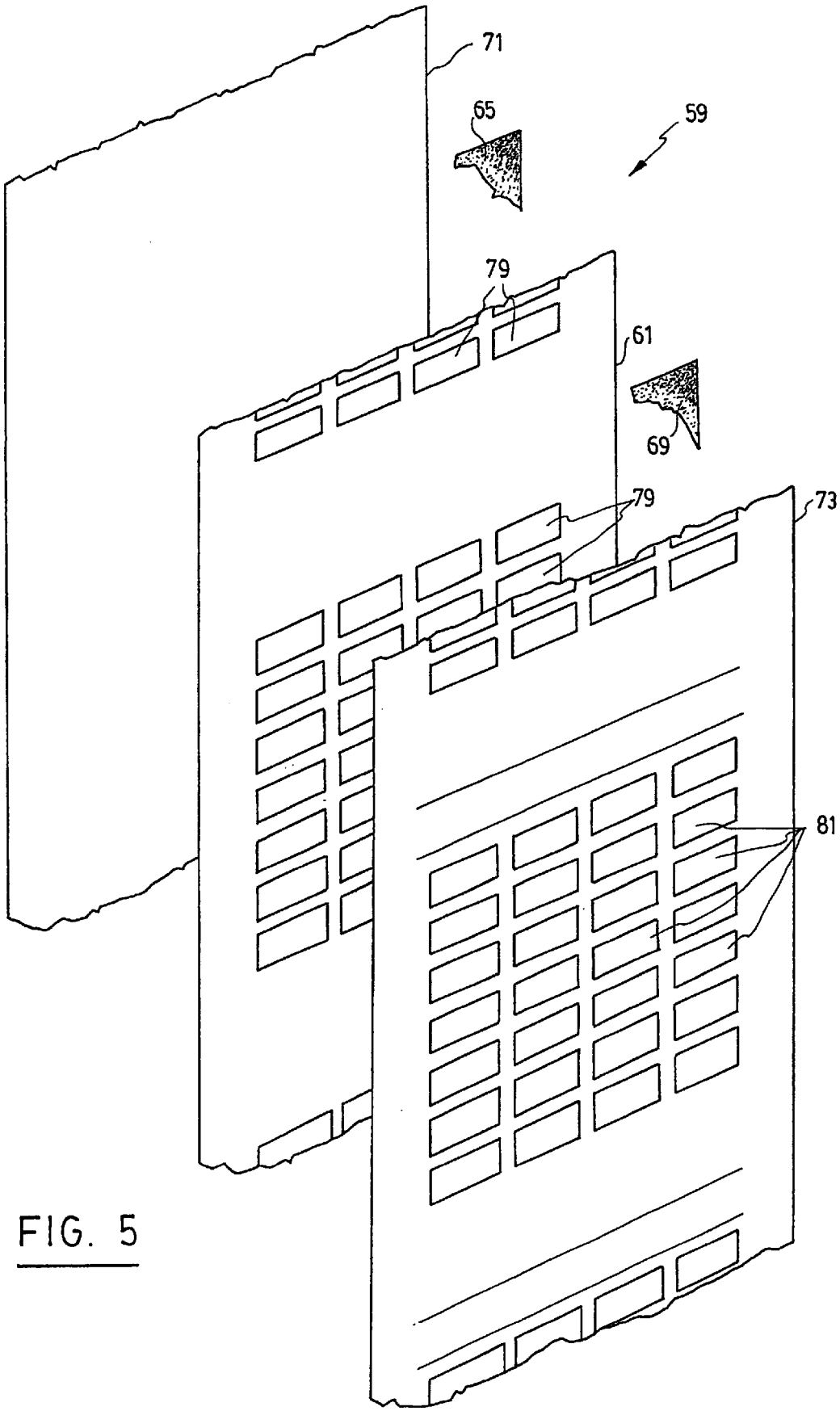
FIG. 5 is an exploded perspective view of the part of the three-layered sheet shown in FIG. 4, after it has been punched in the first dye of the rolling press.

After having been fed into the rolling press 51, the three-layered sheet 59 is pressed by one of the driving rolls 53 against a first dye 77 which is devised to cut spaced apart sets of superimposed pieces 79,81 into both of the central sheet 61 and lower backing sheet 73 as is shown in FIG. 5.

Figure 6:
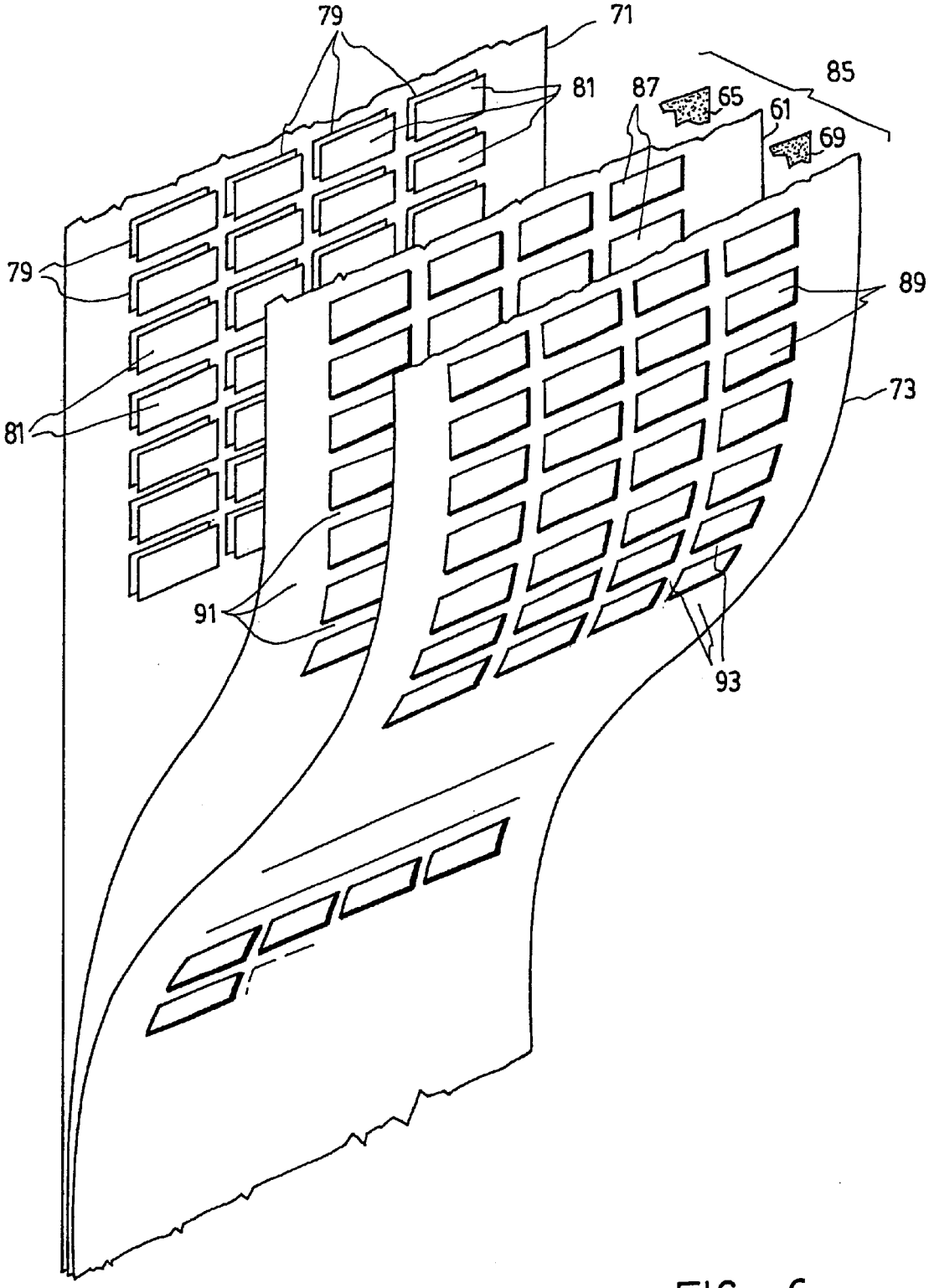
FIG. 6 is an exploded perspective view of the three-layered sheet shown in FIG. 5 after the upper backing sheet that is part of it starts being peeled off just behind the first dye.

Just at the outlet of the first dye 77, the upper backing sheet 71 is peeled off from the central sheet 61 of the three layered-sheet and fed into a rewind core 83 for disposal. As is shown in FIG. 6, the upper baking sheet 71 is actually peeled off together with the sets of pieces 79,81 cut into the central sheet 61 and into the lower backing sheet 73 of the three layered sheet 59. As a result, a two-layered sheet 85 made of said central sheet 61 and lower backing sheet 73 is obtained with holes 87,89 made therein, which correspond to the peeled off pieces 79,81. Of course, the holes 79,81 are surrounded by bands 91,93 left into the central sheet 61 and the lower backing sheet 73.

Figure 3:
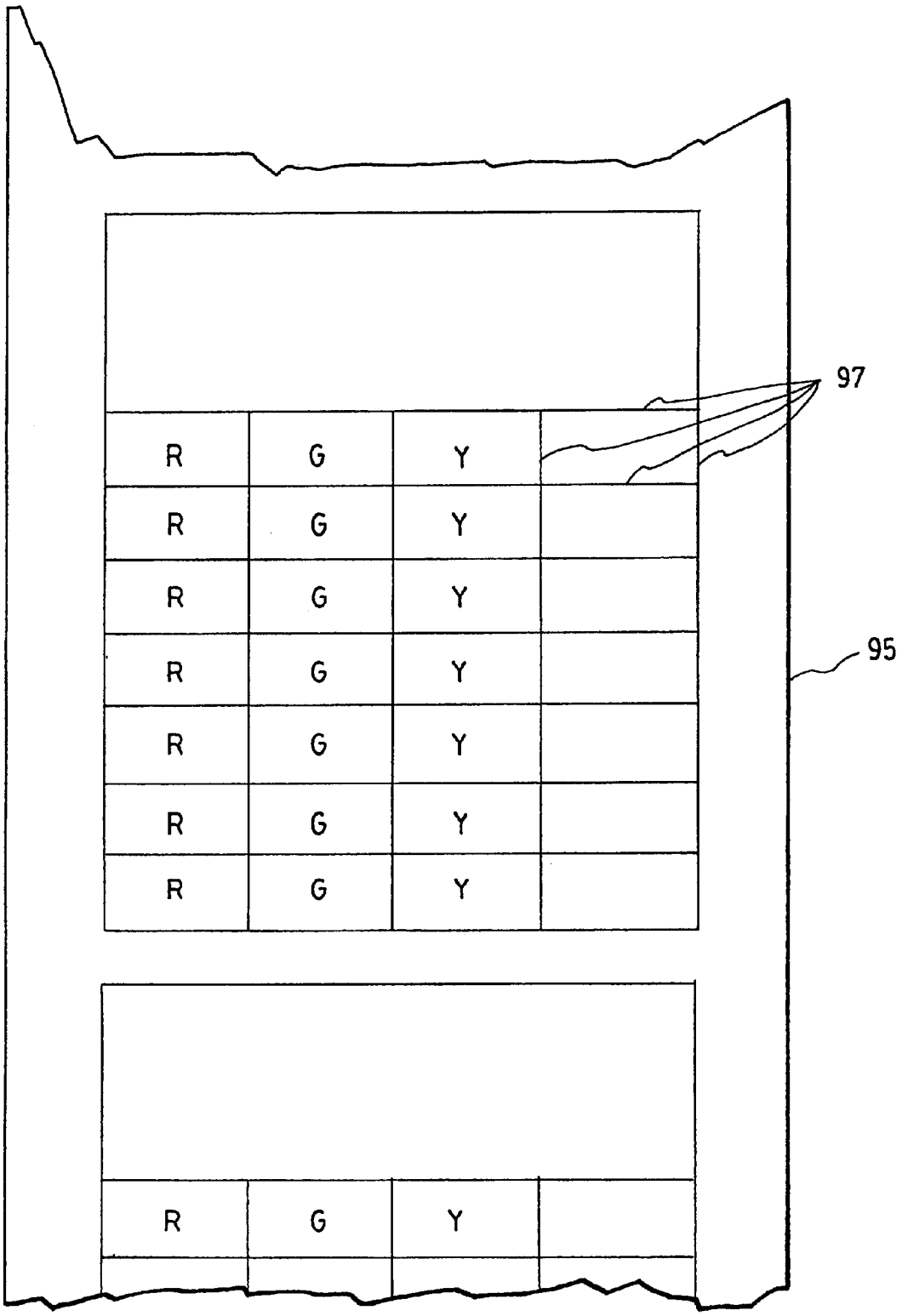
FIG. 3 is a top plan view of part of the sheet used to form the top layer of the sealing sheet, as it is fed to the rolling press.

Simultaneously with the above, a single sheet of paper 95 is fed via another route into the rolling press 51. Prior to being fed into the press 51, the sheet of paper 95 is subjected to a printing in order to form lines 97 defining rows and columns of rectangular pieces that actually correspond to each cover pieces 35 of the sealing sheet 11 once it is completed (see FIG. 3). If wanted, the sheet of paper 95 may also be subjected to a dying in order to color each column of pieces with a different color, such as, for example, red R for the mornings, green G for noone, yellow Y for the evening and white (viz. no coloring) for the night. Of course, such a dying is only optional, as is the selection of colors used to do it.

Figure 7:
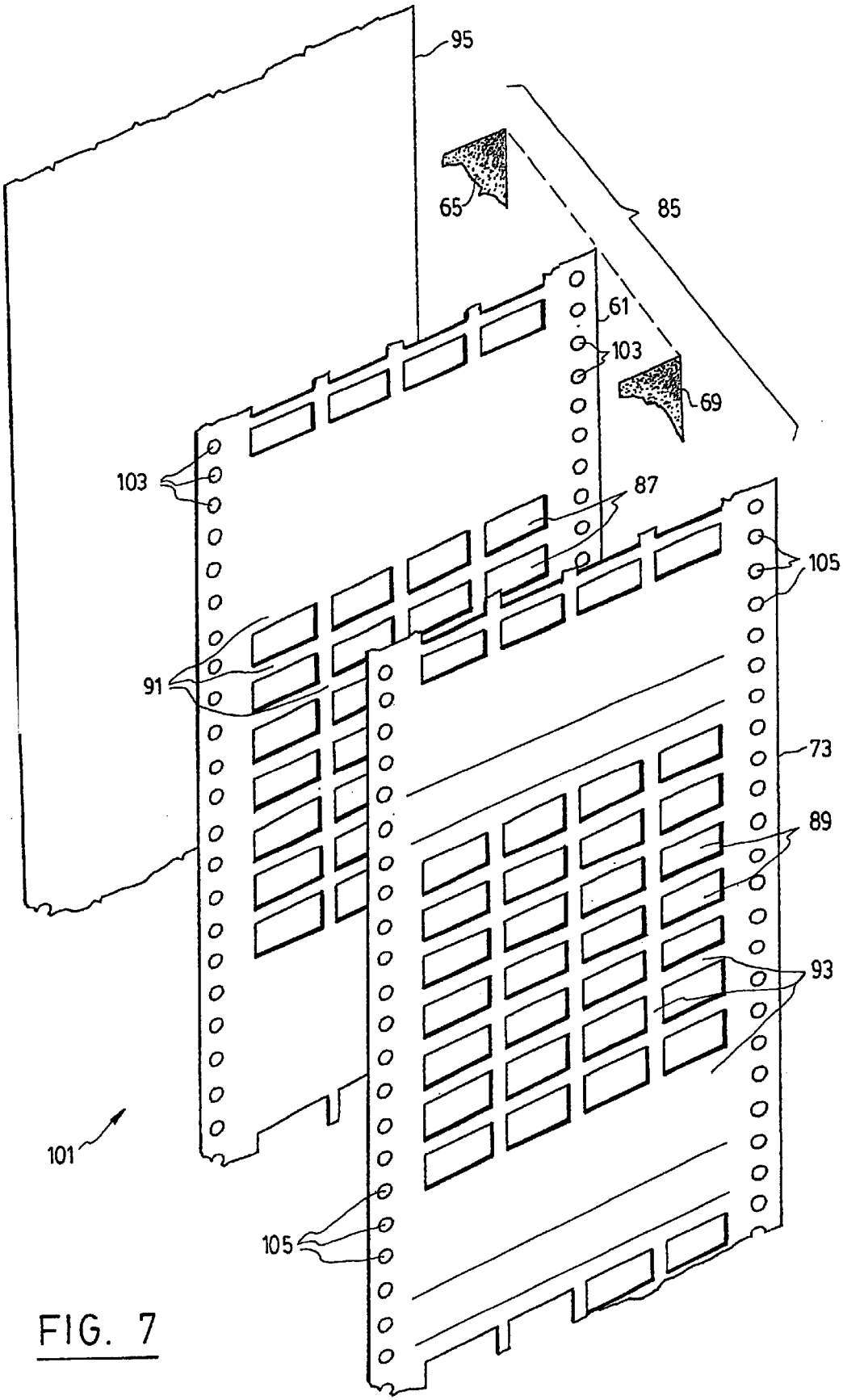
FIG. 7 is an exploded perspective view of part of the sealing sheet obtained after application of the top layer onto the remaining portions of the three-layered sheet and punching of the resulting product into the second dye of the rolling press.

The two layered sheets 85 disclosed hereinabove and the sheet of paper 95 are then simultaneously inserted into a gap formed between a driving roll 53 and a second dye 99 in order to apply the sheet of paper 95 onto the upper layer 65 of pressure sensitive adhesive glue of the central sheet 61 of the two-layered sheets 85 and thus to form another three-layer sheet 101 which actually correspond to the sealing sheet 11 once it is completed. While the two-layered sheet 85 and the sheet of paper 95 pass through the above mentioned gap, the second dye 99 cuts opposite rows of small circles 103,105 into the side edges of both of the central sheet 61 and lower backing sheet 71. It is worth noting that such a cutting of rows of circles is only optional. Indeed, it is of no use in the embodiment shown in FIG. 12 and already discussed hereinabove. The three-layered sheet 101 that is so obtained after having passed over the second dye 99 is shown in FIG. 7.

Then, the three-layered sheet 101 is moved forwards and pressed by another one of the driving rolls 53 against a third dye 107 which performs four different functions.

Figure 8:
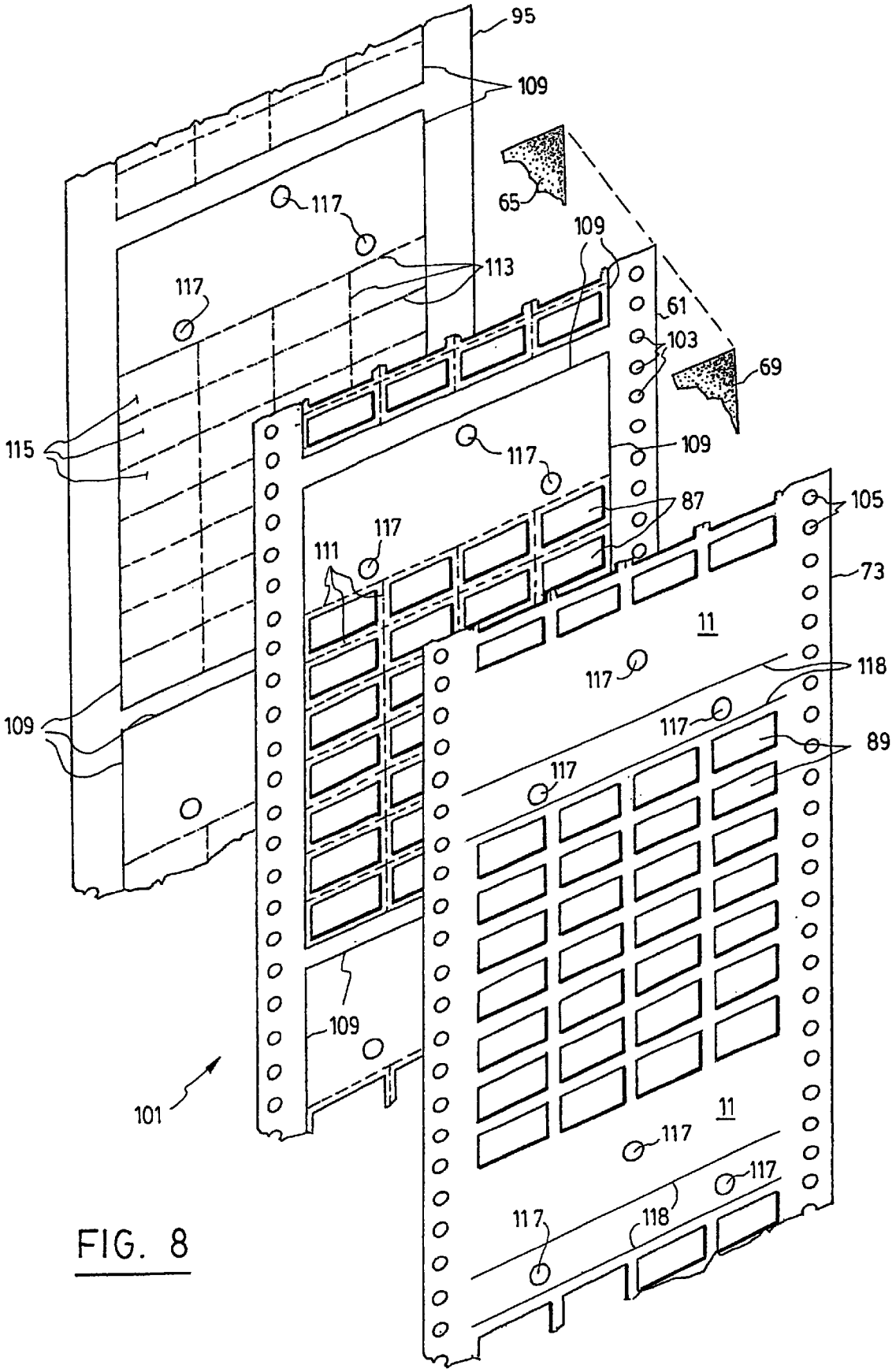
FIG. 8 is an exploded perspective view of part of the sealing sheet shown in FIG. 7 after it has been punched into the third-dye of the rolling press.

First of all, it cuts the external contour 109 of each sealing sheet 11 to be manufactured into the sheet of paper 95 and the central sheet 61 (see FIG. 8).

Secondly, the dye 107 punches tearing lines 111,113 into the sheet of paper 95 and the bands of the central sheet 61 of the three-layered sheet 101 in such a manner as to allow the sheet 95 and the bands of the central sheet 61 to be slit whenever desired into a number of cover pieces 115 equal to the number of holes 87 made in the central sheet 61 (see again FIG. 8). These cover pieces 115 actually correspond to those 35 of the resulting sealing sheets 11.

Thirdly, the dye 107 punches spaced-apart holes 117 through all the components of the three layered sheet 101 within the contours 109 on top of each set of cover pieces 115 (see again FIG. 8). These holes 117 actually correspond to the holes 37 of the resulting sealing sheets 11.

Fourthly, the dye 107 cuts transverse lines 118 into the lower backing sheet 73. Such lines are actually used to form the peelable band 38 mentioned hereinabove.

Figure 9:
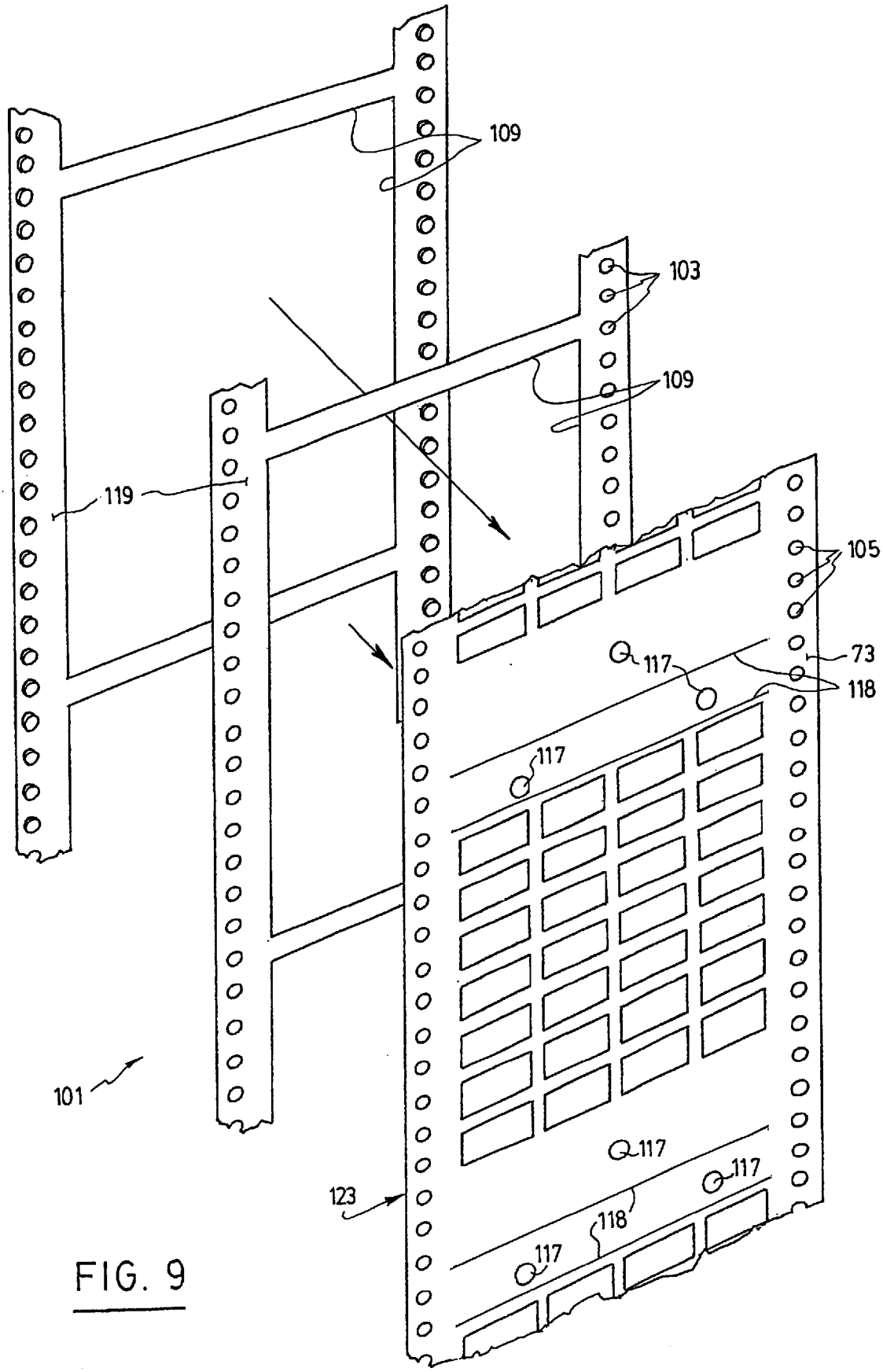
FIG. 9 is an exploded perspective view of part of the sealing sheet shown in FIG. 8 after the peripheral portion of the top sheet is peeled off downstream of the third dye.

After such a processing in the third dye 107, the external parts 119 of the central sheet 61 and of the sheet of paper 95 surrounding the contours 109 are peeled off (see FIG. 9) and fed to a rewind core 121 for disposal while the central parts of the central sheet 61 and the sheet of paper 95 remain glued onto the backing sheet 73. During such a peeling, the dots formed by the circles 103,105 previously cut into the side edges of the central sheet and backing sheet 73 are removed together with the external part 119 of the sheet of paper, and are disposed off.

Figure 10:
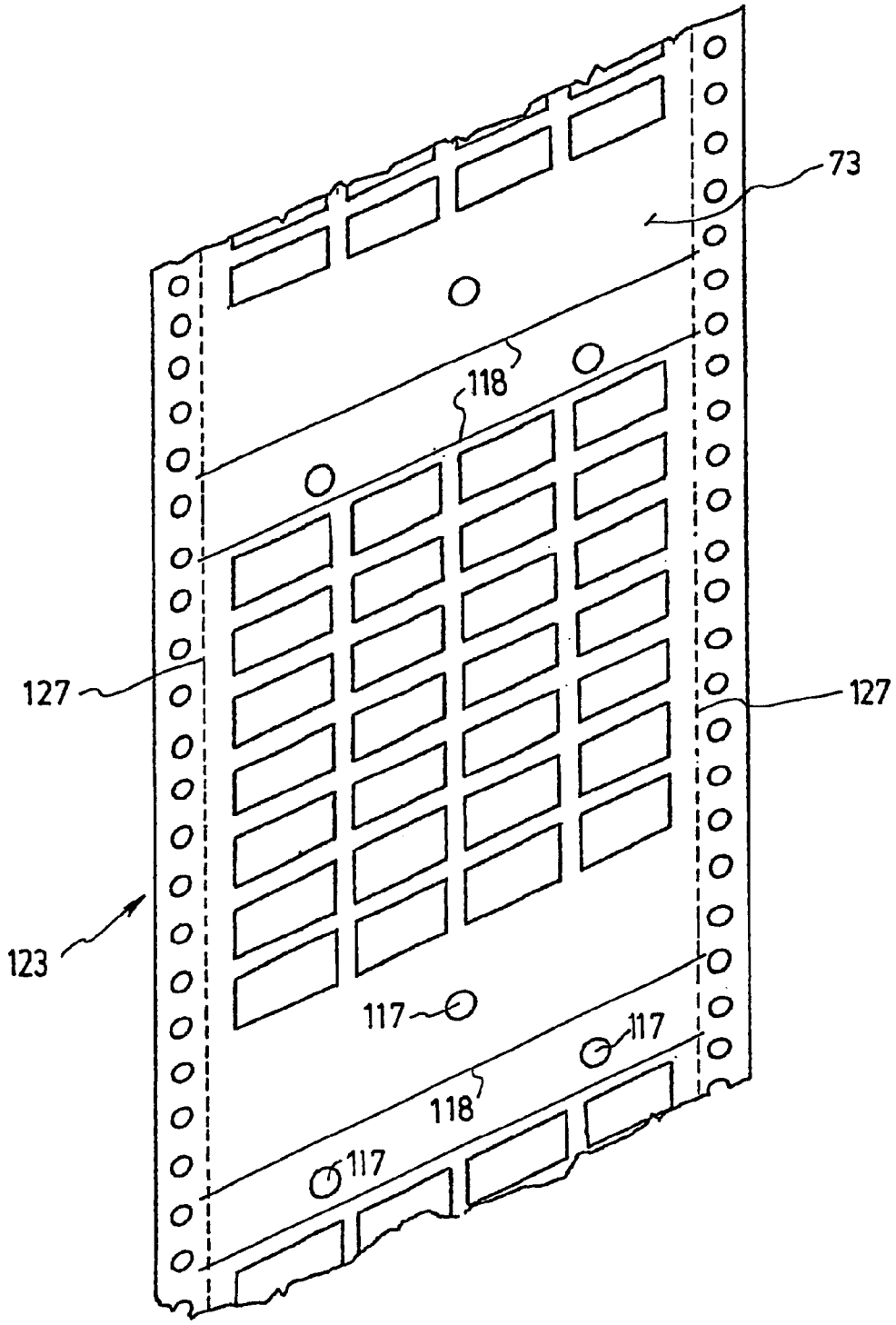
FIG. 10 is a perspective view of part of the sealing sheet shown in FIG. 9 after it is punched with the punching blades of the rolling press.

The resulting product 123 is then moved through a penultimate punching station where a pair of spaced-apart blades 125 punch a pair of tearing lines 127 along both sides of the product 123 (see FIG. 10). These tearing lines 127 actually correspond to the lines 45 of the resulting sealing sheets.

Figure 11:
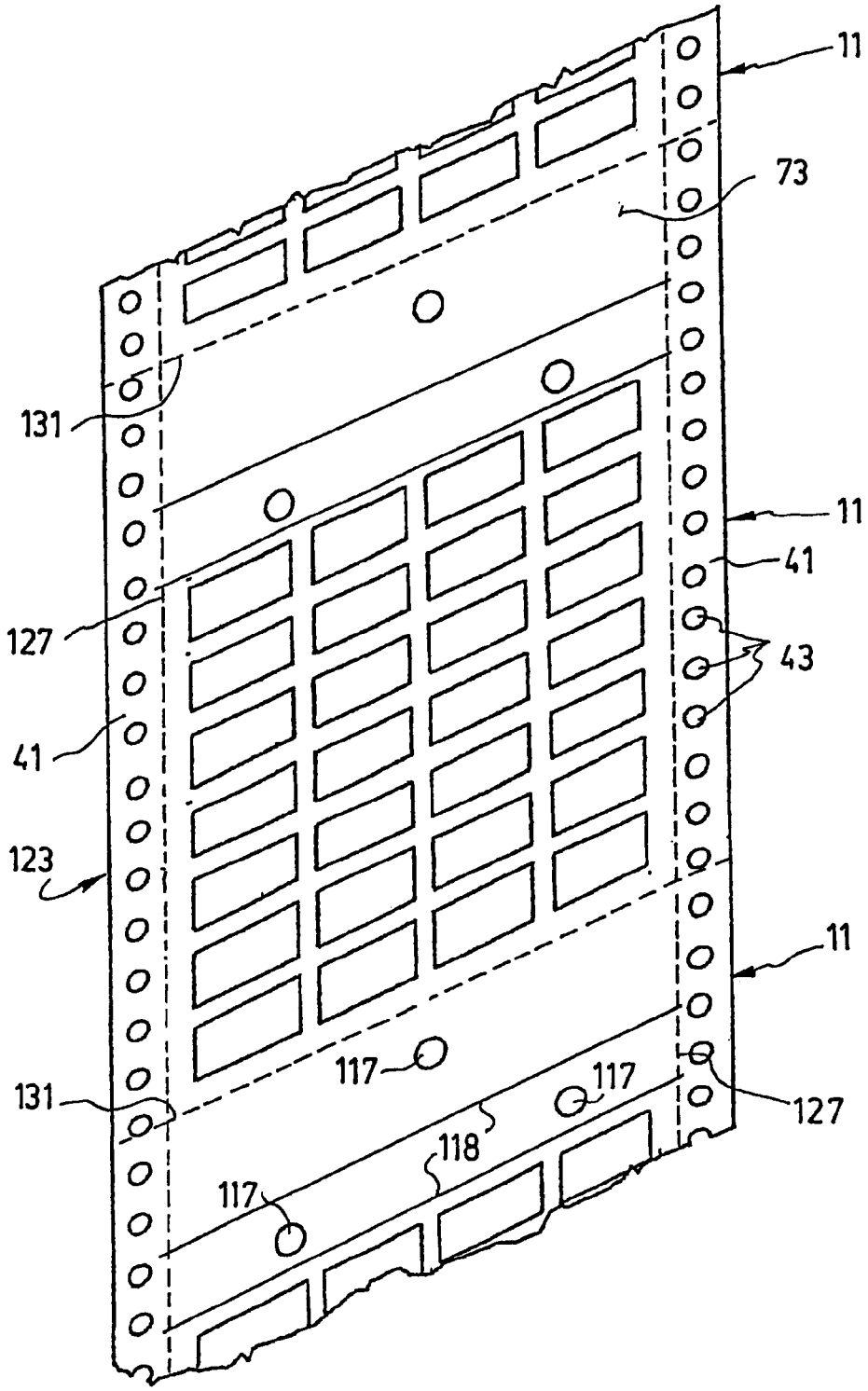
FIG. 11 is a perspective view of part of the sealing sheet shown in FIG. 10 after it has been punched in the fourth dye of the rolling press.
Figure 12:
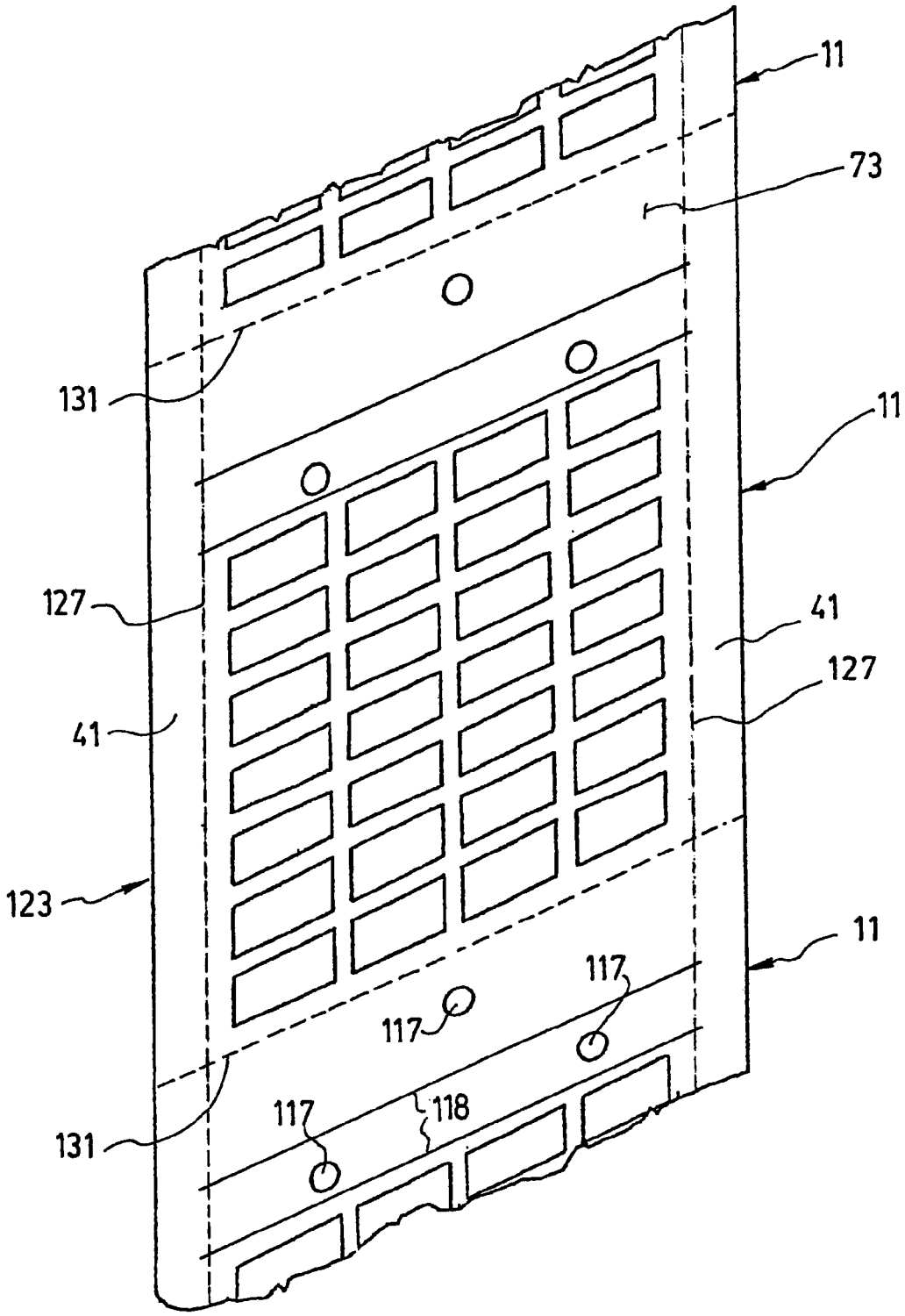
FIG. 12 is a perspective view of a variant of the sealing sheet shown in FIG. 10.

Last of all, the product 123 is moved through a last punching station where a fourth dye 129 punches transverse tearing lines 131 within the spaces separating each group of central parts of the central sheet 61 and the sheet of paper 95 that are glued onto the backing sheet (see FIG. 11). Such lines 131 allows splitting of the product 123 into the requested sealing sheets 11.

Of course, the resulting product is then rolled up onto a core 133 for storage.

From the above, it may be understood that the so-cut sheet of paper 95, the central sheet 61 and the lower backing sheet respectively acts as the top layer 13, the adhesive layer 19 and the backing 29 of each of the so obtained sealing sheets 11.

As aforesaid, the pressure sensitive adhesive glue that is used in the manufacture of the sealing sheets 11 must of course be selected in such manner as to allow peeling off of the components or parts that must be peeled off while allowing all the other components and parts to remain attached.

As it may be appreciated, numerous modifications could be made to the preferred embodiment of the invention as it was disclosed hereinabove without departing from the scope of the present invention.

What is claimed is:

1. A sealing sheet for a container-defining sheet, said sealing sheet comprising:

a top layer made of paper and having an upper surface and a lower surface;

an adhesive layer made of paper and having a plurality of spaced apart holes punched therein, said holes being surrounded by adhesive layer bands that form said adhesive layer, said adhesive layer bands having an upper surface covered with an upper layer of pressure sensitive adhesive glue and a lower surface covered with a lower layer of removable re-positionable pressure sensitive adhesive glue, said adhesive layer bands being fixed to the lower surface of the top layer by said upper layer of pressure sensitive adhesive glue;

a peelable backing having a plurality of spaced apart holes that are positioned, shaped and sized to be in exact superimposition below the holes of the adhesive layer, said holes of the backing being surrounded by backing bands that forms said backing, said backing bands having an upper surface detachably fixed to the lower surface of the adhesive layer bands by means of said lower layer of removable re-positionable pressure sensitive adhesive glue, whereby said backing bands can be peeled off from said adhesive layer bands to allow fixation of the sealing sheet onto the container-defining sheet; and tearing lines punched into the top layer and the adhesive layer bands in such a manner and position as to allow said top layer and adhesive layer to be split into a number of cover pieces equal to the number of holes made in the adhesive layer, each of said cover pieces having one of said holes of said adhesive layer that is centrally positioned therein and fully surrounded by a flange made of parts of said adhesive layer bands.

2. The sealing sheet of claim 1, wherein the holes made in the adhesive layer and in the backing and the tearing lines made in the top layer and in the adhesive layer are positioned in such a manner that the cover pieces are in rows and columns.

3. The sealing sheet of claim 2, further comprising:

positioning means comprising at least two spaced apart holes made into at least the top layer of the sealing sheet to ensure proper positioning of said sealing sheet on top of the container defining sheet during installation.

4. The sealing sheet of claim 3, wherein the positioning means also comprises a peelable band slit into the backing so as to extend across the sealing sheet at the level of the spaced apart holes.

5. The sealing sheet of claim 3, wherein the peelable backing is larger in width than the top layer and the adhesive layer and defines two tearable bands extending along opposite sides of the sealing sheet.

6. The sealing sheet of claim 5, wherein each of said tearable bands is provided with a row of equally spaced apart holes to facilitate driving of the sealing sheet through a printing machine.

7. The sealing sheet of claim 3, wherein the upper surface of the top layer of the sealing sheet comprises information printed on it in such a manner as to be positioned on top of each cover piece.

8. The sealing sheet of claim 7, wherein:

the positioning means also comprises a peelable band slit into the backing so as to extend across the sealing sheet at the level of the spaced apart holes;

the peelable backing is larger in width than the top layer and the adhesive layer and defines two tearable bands extending along opposite sides of the sealing sheet; and each of said tearable bands is provided with a row of equally spaced apart holes to facilitate driving of the sealing sheet through a printing machine.

9. A method for manufacturing sealing sheets as claimed in claim 1, comprising the steps of:

a) providing a three-layered sheet comprising:

a central sheet made of paper and having an upper surface covered with an upper layer of pressure sensitive adhesive glue and a lower surface covered with a lower layer of removable re-positionable pressure sensitive adhesive glue;

an upper backing sheet fixed to the upper surface of the central sheet; and a lower backing sheet detachably fixed to the bottom surface of the central sheet;

b) punching said three-layered sheet in order to cut spaced apart sets of superimposed pieces into both of said central sheet and said lower backing sheet;

c) peeling off the upper backing sheet together with the sets of pieces cut into the central sheet and lower backing sheet of the three-layered sheet, whereby a two-layered sheet made of said central sheet and lower backing sheet with holes therein corresponding to the peeled off pieces is obtained, said holes being surrounded by bands left into said central sheet and said lower backing sheet, d) providing a single sheet of paper;

e) applying said single sheet of paper onto the upper surface of the central sheet of the two-layered sheet obtained in step c) so to form another three-layered sheet;

f) punching tearing lines into the single sheet of the paper and the bands of the central sheet of the three-layered sheet obtained in step e) in such a manner as to allow said single sheet paper and said bands of said central sheet to be slit whenever desired into a number of cover pieces equal to the number of holes made in said central sheet; and g) punching transversed cutting lines in the punched, three-layered sheet obtained in step f) to facilitate splitting of said three-layered sheet into the requested sealing sheets, the so cut-single sheet, central sheet and lower backing sheet respectively acting as top layer, adhesive layer and backing of each of the so obtained sealing sheets.

10. The method of claim 9, comprising the additional step of:

h) perforating rows of holes on opposite sides of the three-layered sheet obtained in step f), said rows of holes facilitating positioning and driving of the resulting sealing sheets into a printing machine; and i) perforating at least two spaced apart holes on top of each of the sealing sheets that is obtained so as to facilitate proper positioning of said sealing sheets on top of a container-defining sheet.

11. The method of claim 10, comprising the additional step of:

g) dyeing with different colors different parts of the single sheet provided in step d) prior to applying it onto the two-layered sheet in step e), the so dyed parts being positioned to extend in rows and to correspond to some of said cover pieces when steps f) is completed.

12. The method of claim 11, wherein steps a) to j) are carried out in continuous manner in a rolling press.

13. In a set of individual pill containers comprising:

a container-defining sheet made of plastic material, said container-defining sheet having a top surface comprising a given number of spaced apart cavities embossed therein, each of said cavities being upwardly opened and thus defining a container, each of said containers being surrounded by a flange, each of the flanges that are not directly adjacent to one side of the container-defining sheet being provided with a central dotted line punched therein to make it possible to detach each of the containers from the adjacent containers and thus from the container-defining sheet whenever desired, and a sealing sheet made of paper and positioned on top of the top surface of the containing-defining sheet in order to close each of said containers, said sealing sheet having a top surface and a bottom surface and being shaped and sized to cover at least all the containers and their surrounding flanges, the bottom surface of said sealing sheet having fixation bands that are positioned, shaped and sized to be in superimposition on top of the flanges of the container-defining sheet, said fixation bands being coated with a removable re-positionable pressure sensitive adhesive glue and being protected by a peelable backing until the sealing sheet is installed onto the containing-defining sheet, said sealing sheet being provided with tearing lines positioned to be in superposition on top of the dotted lines of the container-defining sheet to make it possible to tear said sealing sheet into a number of cover pieces corresponding to the number of said containers and thus to detach each of said containers without having to open the same;

the improvement wherein the sealing sheet comprises:

a top layer made of paper and having an upper surface defining the top surface of the sealing sheet, and a lower surface; and an adhesive layer made of paper and having a plurality of spaced apart holes punched therein, said holes being positioned, shaped and sized to be in exact superimposition on top the containers of the container-defining sheet, and being surrounded by adhesive layer bands that form said adhesive layer, said adhesive layer bands having an upper surface covered with an upper layer of pressure sensitive adhesive glue and a lower surface covered with a lower layer of removable re-positionable pressure sensitive adhesive glue, said adhesive layer bands being fixed to the lower surface of the top layer by said upper layer of pressure sensitive adhesive glue and acting as said fixation bands for use to fix the sealing sheet onto the flanges of the containing-defining sheet by means of said lower layer of removable re-positionable pressure sensitive adhesive glue;

the tearing lines of said sealing sheet being punched into the top layer and into the adhesive layer bands in such a manner and position as to allow said top layer and adhesive layer to be splited into the requested number of cover pieces corresponding to said number of containers.

14. The improved set of claim 13, wherein the top surface of the sealing sheet comprises information printed on it in such a manner as to be positioned on top of each cover piece and thus to correspond to what is located in the corresponding container.

15. The improved set of claim 14, wherein the containers defined by the cavities of the container-defining sheet are positioned to form rows and columns.

16. The improved set of claim 15, wherein the container-defining sheet comprises twenty-eight containers, said containers being positioned to define seven rows and four columns.

17. The improved set of claim 15, further comprising:

positioning means provided on at least the top surface of the container-defining sheet and on the sealing sheet to ensure proper positioning of both of them with respect to each other during installation and thus exact superimposition of the fixation bands and tearing lines of the sealing sheet over the corresponding flanges and dotted lines of the container-defining sheet.

18. The improved set of claim 17, wherein said positioning means consists of at least two spaced apart holes sized to fit onto pins projecting from a recessed support.

19. The improved set of claim 17, wherein the container defining sheet also comprises recesses provided in some of its flanges along the dotted lines made therein so as to give an easy finger access to edges of the sealing sheet in order to facilitate opening of the cover pieces.

* * * * *